US009590329B2

(12) United States Patent
Mann et al.

(10) Patent No.: US 9,590,329 B2
(45) Date of Patent: Mar. 7, 2017

(54) PIN ATTACH CONVERTER

(71) Applicant: International Business Machines Corporation, Armonk, NY (US)

(72) Inventors: Phillip V. Mann, Rochester, MN (US); Mark D. Plucinski, Rochester, MN (US); Sandra J. Shirk/Heath, Rochester, MN (US); Arvind K. Sinha, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/733,353

(22) Filed: Jun. 8, 2015

(65) Prior Publication Data

US 2016/0359246 A1 Dec. 8, 2016

(51) Int. Cl.

| | |
|---|---|
| ***H01R 12/00*** | (2006.01) |
| ***H01R 12/70*** | (2011.01) |
| ***H01R 4/18*** | (2006.01) |
| ***H01R 4/02*** | (2006.01) |

(52) U.S. Cl.

CPC ..... *H01R 12/7076* (2013.01); *H01R 4/02* (2013.01); *H01R 4/18* (2013.01)

(58) Field of Classification Search

CPC ..... H01R 12/585; H01R 12/58; H01R 9/091; H01R 23/727; H05K 3/308

USPC ..... 439/82, 751, 493, 70, 736

See application file for complete search history.

(56) References Cited

U.S. PATENT DOCUMENTS

| | | | | | |
|---|---|---|---|---|---|
| 2,814,024 | A | * | 11/1957 | Narozny | H01R 9/091 439/58 |
| 3,621,445 | A | * | 11/1971 | Horecky | H01R 9/091 174/267 |
| 3,832,603 | A | * | 8/1974 | Cray | H05K 3/368 361/774 |
| 3,860,323 | A | * | 1/1975 | Fischer | H01R 4/00 439/217 |
| 4,236,776 | A | * | 12/1980 | Wellington | H05K 3/308 439/83 |
| 4,420,877 | A | * | 12/1983 | McKenzie, Jr. | H05K 3/308 228/180.1 |
| 4,660,922 | A | * | 4/1987 | Cooney | H01R 13/04 439/884 |

(Continued)

FOREIGN PATENT DOCUMENTS

| | | | |
|---|---|---|---|
| JP | 2001024393 | A | 1/2001 |
| JP | 4492799 | B2 | 6/2010 |

(Continued)

*Primary Examiner* — Abdullah Riyami
*Assistant Examiner* — Vladimir Imas
(74) *Attorney, Agent, or Firm* — Mark G. Edwards

(57) ABSTRACT

A pin attach converter for coupling an electrical contact to a printed circuit board may include a compliant region having a first length adapted to traverse an aperture in a printed circuit board and provide mechanical and electrical registry with at least one wall of the aperture. The pin attach converter may also include an adapter region coupled to the compliant region, and having a cavity with a second length and adapted to receive the electrical contact, where the second length extends along a same longitudinal axis as the first length, and the cavity is adapted to provide mechanical and electrical registry with the electrical contact.

17 Claims, 4 Drawing Sheets

(56) References Cited

U.S. PATENT DOCUMENTS

RE32,540 E * 11/1987 Murphy ..... B65D 73/0042 206/347
4,718,854 A * 1/1988 Capp ..... H01R 24/50 439/108
4,797,113 A * 1/1989 Lambert ..... H01R 12/52 439/295
5,002,507 A * 3/1991 Sitzler ..... H01R 12/58 439/751
5,059,130 A * 10/1991 Miller, Jr. ..... H01R 12/523 439/74
5,176,254 A * 1/1993 Caravona ..... B65D 65/46 206/524.7
5,456,608 A * 10/1995 Rogers ..... H01R 29/00 29/845
5,915,999 A 6/1999 Takenaka et al.
6,132,225 A 10/2000 Murr et al.
6,168,441 B1 * 1/2001 Buchart ..... H01R 12/585 439/751
6,984,796 B2 * 1/2006 Blossfeld ..... H01H 1/5805 200/245
7,108,521 B2 * 9/2006 Watanabe ..... H01R 12/58 439/82
7,228,628 B2 * 6/2007 Wolfel ..... H01R 12/585 29/874
7,377,823 B2 5/2008 Chen
7,828,561 B2 11/2010 Gueckel
8,324,642 B2 * 12/2012 Grajcar ..... H01L 33/483 257/81
8,545,237 B2 * 10/2013 Johnson ..... H01R 12/523 439/75
9,093,775 B2 * 7/2015 Perez-Uria ..... H05K 3/368
2004/0180583 A1 9/2004 Maruyama et al.
2007/0093143 A1 * 4/2007 Nomura ..... H01R 12/585 439/751
2008/0207015 A1 * 8/2008 Sueyoshi ..... H05K 3/308 439/75
2011/0207363 A1 * 8/2011 Shimizu ..... H01R 13/111 439/374
2012/0088381 A1 * 4/2012 Wild ..... H01R 13/17 439/131
2014/0345124 A1 11/2014 Patzner et al.

FOREIGN PATENT DOCUMENTS

JP 2010186658 A 8/2010
JP 2013025974 A 2/2013

* cited by examiner

PIN ATTACH CONVERTER

BACKGROUND

The present disclosure relates to electrical circuits, and more specifically, to an adapter for attaching a compliant electrical contact to a solder tail electrical contact.

Printed circuit board electrical connector can include compliant press fit pin connectors and solder tail connectors. Compliant press fit pin connectors may be used on thick printed circuit boards (e.g., backplanes) that make it difficult to attach solder tail connectors. Solder tail connectors may be used on thin or flexible printed circuit boards where enough of the pin sticks through the board for the soldering process.

SUMMARY

According to embodiments of the present disclosure, a pin attach converter for coupling an electrical contact to a printed circuit board may include a compliant region having a first length adapted to traverse an aperture in a printed circuit board and provide mechanical and electrical registry with at least one wall of the aperture. The pin attach converter may also include an adapter region coupled to the compliant region, and having a cavity with a second length and adapted to receive the electrical contact, where the second length extends along a same longitudinal axis as the first length, and the cavity is adapted to provide mechanical and electrical registry with the electrical contact.

Various embodiments are directed towards a pin attach converter for coupling an electrical contact to a printed circuit board. The pin attach converter may include a compliant region having a shoulder portion and a compliant portion coupled to the shoulder portion along a longitudinal axis of the compliant region, and configured to compress by interference a wall of an aperture in a printed circuit board to provide at least one of mechanical and electrical registry the wall. The pin attach converter may further include an adapter region having a first end with an opening forming a cavity having a height extending along a same longitudinal axis and adapted to receive an electrical contact, and a closed second end coupled to the compliant region along a the longitudinal axis.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
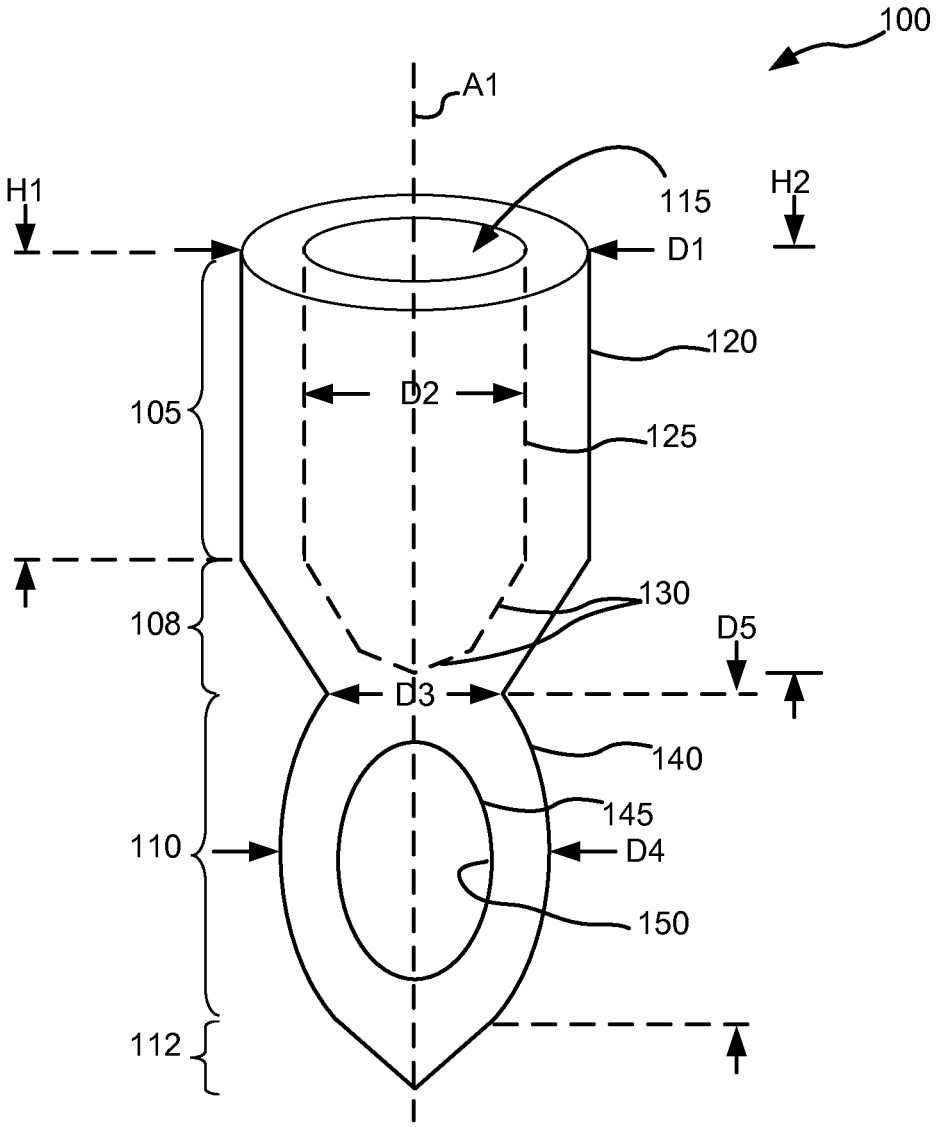
FIG. 1 schematically depicts an embodiment of a pin attach converter.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to electrical circuits, and more particular aspects relate to an adapter for attaching a compliant electrical contact to a solder tail electrical contact. While the present disclosure is not necessarily limited to such applications, various aspects of the disclosure may be appreciated through a discussion of various examples using this context.

Embodiments of this disclosure are directed towards a pin attach converter that enables electrical connectors having solder tail contacts to be used in printed circuit board (PCB) applications configured to receive a compliant press fit electrical contacts.

An electrical connector may include a coupling portion and a contact portion. The coupling portion may interface with, for example, another connector, an electronic component, or a PCB application (e.g., through a via or aperture in the PCB). The contact portion may be configured to interface or couple with electrical traces in/on a PCB. The contact portion of some connectors may include either a compliant or a solder tail section.

Electrical connector contacts having a compliant contact section may enable printed circuit board applications to be assembled without the use of electrical solder. The compliant section of these connectors may be a flat electrical pin, with at least a portion of the pin (e.g., a complaint region) having cross section that may be nominally larger than an aperture in a PCB configured to receive the contact (e.g., in a plated through-hole mounting scheme). The aperture may be a cylindrical opening in the PCB having plated walls contacting electrical traces. When the compliant contact is inserted into the aperture, the walls of the aperture may compress a compliant region of the contact (e.g., like a spring), providing mechanical and electrical registry with the contact.

An electrical connector contact having a solder tail contacts may enable printed circuit board applications to be assembled using soldering processes such as wave soldering. The solder tail contact may be a pin (e.g., a narrow cylindrical electrical contact) that extends from the coupling section. The solder tail may be inserted into an aperture of a PCB, and may be electrically and mechanically bonded to an electrical trace by soldering.

Embodiments of the present disclosure are based on the recognition that there are situations where an electrical connector having compliant pin contacts may be needed for use in a PCB application, but available connectors may be tooled for solder tail applications. Having the connectors tooled for a specific PCB application may not be cost effective. Additionally, when the PCB is thick, as in a backplane application, soldering the connector to the PCB can add time and difficulty to the application. Various embodiments of the present disclosure may enable an electrical connector having a solder tail contact to be used in PCB applications requiring compliant pin contacts.

Referring now to the figures, FIG. 1 schematically depicts an embodiment of a pin attach converter 100, according to various embodiments. The pin attach converter 100 may include adapter region 105, shoulder region 108, compliant region 110, and tip region 112. The pin attach converter 100 may be a single mechanically and electrically contiguous unit formed using know materials (e.g., metallic alloys such as copper, silver, and/or tin) and methods (e.g., stamping, casting, and/or welding). Furthermore, at least a portion of pin attach converter 100 may be coated with a conductive metallic alloy (e.g., copper, silver, and/or tin).

The adapter region 105 may include an outer wall 120, and an inner wall 125 formed by a cavity 115. The outer wall 120 may be cylindrical with a diameter D1 and a height H1 (e.g., a first height). The outer wall 120 may also form other three-dimensional shapes, including polyhedrons which is perpendicular to the diameter D1. A cross section of adapter region 105 taken perpendicular to a longitudinal axis A1 (e.g., an axis parallel to the height of adapter region 105 or outer wall 120) may, for example, be circular, rectangular, triangular, or hexagonal. At least a portion of outer wall 120 may be coated with a metallic alloy (e.g., copper, silver, and/or tin), or an insulating material (e.g., rubber, or plastic).

The cavity 115 may be cylindrical with a diameter D2, and a wall 125 (e.g., the inner wall) having a height H2 (e.g., a second height) extending into adapter region 105 parallel to the longitudinal axis A1. In some embodiments, the cavity 115 may have a first cylindrical portion with a height defined by wall 125 and circular cross section having diameter D2. The cavity 115 may also have a conical tip region 130 having a tip and circular cross section of the cylindrical portion for a base. The magnitude of diameter D2 and the height of wall 125 may be selected to accommodate an electrical contact having a given length and diameter (e.g., the diameter D2 may be larger than a diameter of the electrical contact, while the height of wall 125 may be tall enough to enable cavity 115 to receive at least a portion of the electrical contact). In certain embodiments, the second conical tip region 130 may extend parallel to the longitudinal axis A1 into the shoulder region 108. The cavity 115 (and thus the wall 125) and conical tip region 130 may form other three-dimensional shapes, including, for example, polyhedrons such as cuboids.

Shoulder region 108 may be conical with a first base having a circular cross section of diameter D1 and a second base having a circular cross section of diameter D3. In some embodiments, the first base may have a diameter larger than D2, creating a surface (e.g., a ledge) for pressing the pin attach converter 100 into an aperture of a PCB. In certain embodiments, the first and/or second base(s) may have a rectangular, triangular or other polygonal cross section. The cross section of the first and/or second base(s) may be different from the cross section of outer wall 120 and cavity 115.

The compliant region 110 may correspond with a compliant portion of a compliant pin. Compliant region 110 may include a base or stem (not shown) coupling complaint region 110 to shoulder region 108. In some embodiments, compliant region 110 may have a substantially flat shape defined by an outer wall 140 having diameter D4, an inner wall 145, and a central cavity or eye 150. The compliant region may also have a length D5 extending parallel to the longitudinal axis A1. The outer wall 140 may be coated with a conductive metallic alloy that may withstand the stress of the pin attach converter 100 being inserted into a PCB aperture without stripping (e.g., without the outer wall losing the metallic coating).

The tip region 112 may be substantially flat and include a base portion (not shown) coupling the tip region to the compliant region 110. In some embodiments, tip region 112 may be an integral part of compliant region 110.

Figure 2:
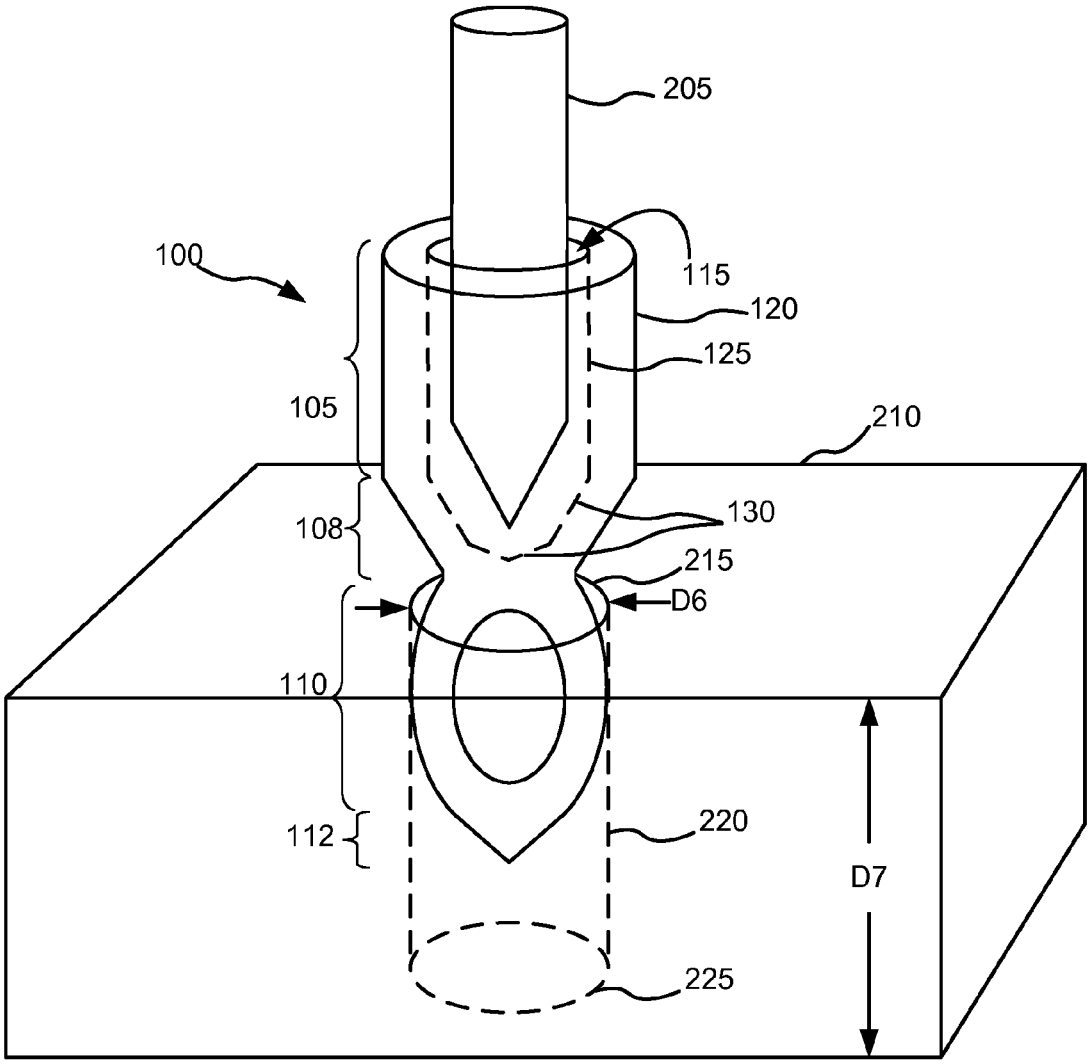
FIG. 2 schematically depicts a perspective view of an embodiment of a pin attach converter with an electrical contact in a cavity of an adapter region and a compliant region inserted into an aperture of a printed circuit board, according to various embodiments.

FIG. 2 schematically depicts a perspective of an embodiment of a pin attach converter 100 with an electrical contact 205 in a cavity of an adapter region 105 and a compliant region 110 inserted into an aperture of a PCB 210.

As shown in FIG. 2, the adapter region 105 may receive a length of electrical contact 205 in the cavity 115. The electrical contact 205 may be a solder tail contact of an electrical connector. The electrical contact 205 may have any length, diameter, or geometry that can be accommodated by cavity 115. The electrical contact 205 may be electrically and/or mechanically coupled to the adapter region 105 using solder (e.g., electrical solder) deposited, for example, contiguously in cavity 115 and on the electrical contact by know soldering processes. When soldering is used to couple the electrical contact 205 to adapter region 105 the dimensions of the electrical contact and the diameter of the cavity 115 may be selected to enable an amount of solder to be deposited between the electrical contact and the inner wall 125 of the cavity. The adapter region 105 may be made of a metallic alloy having a higher melting point than the solder. The adapter region 105 may also be coated with a heat-resistive material. In some embodiments, a charge solder or other coupling material may be deposited into conical tip region 130 and into at least a portion of cavity 115 before the electrical contact 205 is coupled to the adapter region 105. In certain embodiments, the electrical contact 205 may be coupled to adapter 105 by other coupling methods, including crimping, and/or compression/swage coupling where a plurality of teeth radially extending from at least one wall of the cavity 115 towards a center of the cavity for engagement with the electrical contact.

The shoulder region 108 may limit the depth to which the pin attach converter 100 may be inserted into the aperture 215. For example, when the first and/or second base(s) of shoulder region 108 is wider than a diameter D6 of aperture 215, the pin attach converter 100 may be inserted into the aperture up to a depth determined by the first and/or second base(s). In embodiments where the first and/or second base(s) have a diameter that is wider than the diameter of outer wall 120, shoulder region 108 may form a ledge (not shown) for pushing the pin attach converter 100 into aperture 215.

The compliant region 110 may be inserted into aperture 215 to a depth determined by shoulder region 108. The diameter of compliant region 110 may correspond with the diameter D6 such that the compliant region achieves mechanical and electrical registry with the walls 220 when inserted into aperture 215. In some embodiments, the diameter of the compliant region 110 may be compressed (e.g., reduced in width or magnitude) by interference or contact with the walls 220. The length of the compliant region 110 may be selected to enable a large enough mechanical and electrical contact between the compliant region and the walls 220 to stably support the pin attach converter 110 (e.g., to enable the pin attach converter to support an electrical contact 205 in a PCB application without being damaged electrically or mechanically).

The tip region 112 may be inserted into the aperture 215 to a depth determined by the length of compliant region 110 and the thickness D7 of the PCB 210. The tip region 112 may serve as a positioning or insertion guide for the pin attach converter 100 by, for example, signaling to an insertion mechanism that the pin attach converter is inserted to an appropriate depth. In some embodiments, the tip region 112 may traverse a second aperture 225 of the PCB 210.

Figure 3:
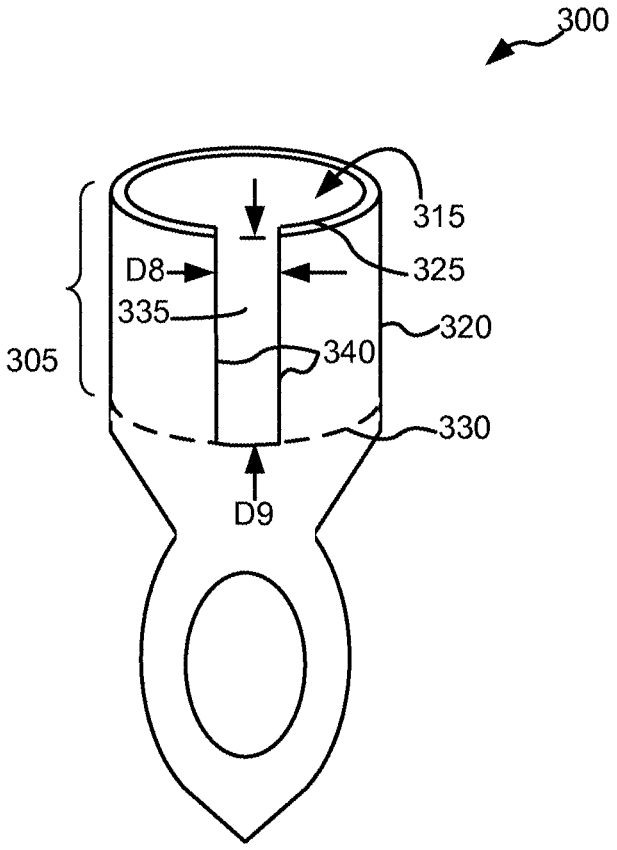
FIG. 3 schematically depicts an embodiment of a pin attach converter with the adapter region configured to couple to an electrical contact by crimping, according to various embodiments.

FIG. 3 schematically depicts an embodiment of a pin attach converter 300 with the adapter region 305 configured to couple to an electrical contact by crimping, according to various embodiments. The pin attach converter 300 may be an embodiment of the pin attach converter 100 with the exception that the adapter region 305 has been modified to support an electrical contact by crimping. As shown in FIG. 3, a portion of an outer wall 320 and an inner wall 325 was removed from an adapter region 305 of the pin attach converter 300 to create an opening 335 having walls 340, width or diameter D8, and height D9. When the adapter region 305 is crimped, the opening 335 may enable walls 340 to collapse onto and secure an electrical contact inserted into a cavity 315 of the pin attach converter 300. The width D8 and height D9 may be selected to enable the crimped adapter region 305 to support an electrical contact in a given PCB application. A circular cross section 330 of the adapter region 305 extending from outer wall 320 inward to inner wall 325 may be perforated, stamped or made of a thinner or weaker material than the rest of the pin attach converter 300 to facilitate crimping.

Figure 4:
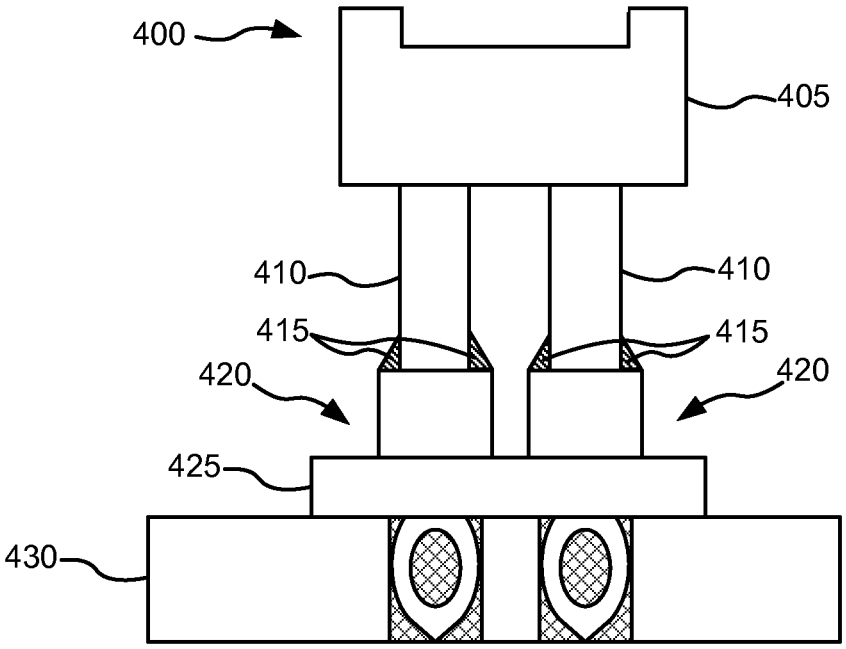
FIG. 4 schematically depicts a cross sectional view of an electrical connector having a set of solder tail contacts soldered to a set of pin attach converters, according to various embodiments.

FIG. 4 schematically depicts a view of an electrical connector 400 having a set of solder tail contacts 410 soldered to a set of pin attach converters 420, according to various embodiments. The electrical connector 400 includes coupling portion 405, and a contact portion having solder tail contacts 410. The solder tail contacts can be coupled to pin attach converters 420 using an electrical solder 415. A connecting portion 425, contiguous with a shoulder regions of pin attach converters 420, may structurally link the pin attach converters. The connecting portion 425 may also provide a surface or ledge for applying a force to insert the pin attach converters 420 in PCB 430.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A pin attach converter for coupling an electrical contact to a printed circuit board, comprising:

a flat compliant region having a first length adapted to traverse an aperture in a printed circuit board and to provide mechanical and electrical registry with at least one wall of the aperture; and an adapter region coupled to the compliant region, the adapter region having a cavity with a second length, the cavity adapted to receive the electrical contact and to provide mechanical and electrical registry with the electrical contact, wherein the second length extends along a same longitudinal axis as the first length, a first portion of the cavity extending coincident with the second length has a first diameter and a second portion of the cavity extending coincident with the second length includes a conical tip having a base with the first diameter and linearly sloped sides extending from the base to a point at the end of the second portion.

2. The pin attach converter of claim 1, wherein the electrical contact is a solder tail pin.

3. The pin attach converter of claim 1, wherein at least a portion of the adapter region includes a plurality of teeth radially extending from at least one wall of the cavity towards the same longitudinal axis for engagement with the electrical contact.

4. The pin attach converter of claim 1, wherein at least a portion of the adapter region is adapted to engage the electrical contact by crimping.

5. The pin attach converter of claim 1, wherein at least a portion of the adapter region is adapted to engage the electrical contact by soldering.

6. The pin attach converter of claim 1, wherein both the compliant region and the adapter region include a metallic coating.

7. The pin attach converter of claim 1, wherein the compliant region provides electrical registry between the electrical contact and the at least one wall of the aperture.

8. The pin attach converter of claim 1, wherein the aperture is a plated through hole.

9. The pin attach converter of claim 1, wherein the canonical top includes a charge of solder.

10. A pin attach converter for coupling an electrical contact to a printed circuit board, comprising:

a flat compliant region having a shoulder portion and a compliant portion coupled to the shoulder portion along a longitudinal axis of the compliant region, and configured to compress by interference a wall of an aperture in a printed circuit board to provide at least one of mechanical and electrical registry the wall; and an adapter region having a first end with an opening forming a cavity having a height extending along a same longitudinal axis and adapted to receive an electrical contact, and a closed second end coupled to the compliant region along a the longitudinal axis, wherein the closed second end includes a conical tip portion having a base with a first diameter and linearly sloped sides extending from the base to a point at the end of the closed second end, the conical tip portion adapted to receive a portion of solder.

11. The pin attach converter of claim 10, wherein the electrical contact is a solder tail pin.

12. The pin attach converter of claim 10, wherein at least a portion of the adapter region includes a plurality of teeth radially extending from at least one wall of the cavity towards the same longitudinal axis for engagement with the electrical contact.

13. The pin attach converter of claim 10, wherein at least a portion of the adapter region is adapted to engage the electrical contact by crimping.

14. The pin attach converter of claim 10, wherein at least a portion of the adapter region is adapted to engage the electrical contact by soldering.

15. The pin attach converter of claim 10, wherein both the compliant region and the adapter region include a metallic coating.

16. The pin attach converter of claim 10, wherein the compliant region provides electrical registry between the electrical contact and the at least one wall of the aperture.

17. The pin attach converter of claim 10, wherein the aperture is a plated through hole.

* * * * *